US007457096B2

(12) United States Patent
Brundula

(10) Patent No.: US 7,457,096 B2
(45) Date of Patent: Nov. 25, 2008

(54) SYSTEMS AND METHODS FOR ARC ENERGY REGULATION

(75) Inventor: Steven N. D. Brundula, Chandler, AZ (US)

(73) Assignee: TASER International, Inc., Scottsdale, AZ (US)

( * ) Notice: Subject to any disclaimer, the term of this patent is extended or adjusted under 35 U.S.C. 154(b) by 246 days.

(21) Appl. No.: 11/381,454

(22) Filed: May 3, 2006

(65) Prior Publication Data

US 2007/0075261 A1 Apr. 5, 2007

(51) Int. Cl.
*H01T 23/00* (2006.01)

(52) U.S. Cl. ..... 361/232

(58) Field of Classification Search ..... 361/232
See application file for complete search history.

(56) References Cited

U.S. PATENT DOCUMENTS 3,699,388 A 10/1972 Ukai
4,582,063 A 4/1986 Mickiewicz et al.
4,644,439 A 2/1987 Taarning
5,124,905 A 6/1992 Kniepkamp
5,215,066 A 6/1993 Narishige et al.
6,937,455 B2 8/2005 Krichtafovitch et al.
6,999,295 B2 * 2/2006 Watkins et al. ..... 361/232
7,057,872 B2 * 6/2006 Smith et al. ..... 361/232
7,280,340 B2 * 10/2007 Smith et al. ..... 361/232

* cited by examiner

*Primary Examiner*—Kiet T Nguyen
(74) *Attorney, Agent, or Firm*—William R. Bachand

(57) ABSTRACT

A driver provides a current through a load circuit that includes an ionizable path. The driver includes an energy sourcing circuit, an ionization detector, a controller, and a pulse generator. The controller determines, in response to the detector and by trial and error, a respective quantity of energy for each pulse of a plurality of pulses to be generated. For each pulse of the plurality, the pulse generator receives the respective quantity of energy from the energy sourcing circuit, provides in response to the quantity of energy a respective voltage to ionize the ionization path, and provides the current through the load circuit.

20 Claims, 3 Drawing Sheets

SYSTEMS AND METHODS FOR ARC ENERGY REGULATION

FIELD OF THE INVENTION

Embodiments of the present invention relate to systems and methods for arc energy regulation.

BACKGROUND OF THE INVENTION

An electric arc formed between a pair of conductors that are separated by an otherwise insulating gas may be designed to provide light, heat, sound, or radio frequency signals. By providing heat, the arc may be used to ignite the gas, for example for producing light, heat or propulsion. In other applications for an electric arc, the arc may be designed to complete a circuit for current to flow through the arc and through a load. A circuit that causes an arc to form and thereafter supplies a current through the load is a drive circuit, as opposed to merely an igniter circuit, in part because it impresses across the conductors a voltage high enough to cause ionization of the gas and then provides a current through the arc and through the load. Prior to ionization, the insulating effect of the gas prevents current from flowing through the load. After ionization, the arc offers little resistance to current flow. An arc may be extinguished by reducing current flow through the arc to less than a current sufficient to maintain the arc or by increasing the insulating effect between the conductors (e.g., further separating the conductors, introducing matter between the electrodes of greater insulating effect, or removing ionized matter). With appropriate control circuits in the driver, the arc may perform a function of a switch to enable or disable current flow through the load.

It may be desirable to use as little energy as possible to overcome the insulating effect of the separation between the conductors, for example, so that a limited source of energy is conserved for completing the purposes of the current through the load. Battery powered applications are among those applications having a limited source of energy.

A conventional driver for a load that is isolated in the absence of an arc generally provides a fixed and relatively large amount of energy to assure ionization. There remains a need for a driver and methods performed by a driver that supplies an efficient amount of energy for ionization. There is a further need for a driver and methods performed by a driver that supplies an efficient amount of energy for ionization that may vary to meet changes from time to time in the insulating effect between the conductors. For example, the relatively large amount of energy expended for an ionization in a conventional igniter may be based on a theoretical maximum distance between the conductors. In other applications of igniters and drivers, the distance between the conductors may vary greatly. Using a fixed maximum amount of energy for every ionization can lead only to inefficient waste of energy for some ionization events.

Implementations according to various aspects of the present invention solve the problems discussed above and other problems, and provide the benefits discussed above and other benefits as will be apparent to a skilled artisan in light of the disclosure of invention made herein.

SUMMARY OF THE INVENTION

A driver provides current through a load that includes an ionizable path. The driver includes an ionization detector and a signal generator. The ionization detector provides indicia of a quantity of energy in response to detecting ionization during a first operation of the signal generator. The signal generator provides, in a second operation of the signal generator, a voltage to ionize the ionization path, and after ionization provides a current through the load. The voltage corresponds to an energy less than the quantity of energy.

A method, performed by a driver, provides a current through a load after ionization that forms a circuit for the current through the load. The method includes in any practical order: (a) accomplishing a first ionization; (b) in response to the first ionization, determining a first energy; (c) attempting a second ionization using a second energy less than that first energy.

BRIEF DESCRIPTION OF THE DRAWING

Embodiments of the present invention will now be further described with reference to the drawing, wherein like designations denote like elements, and.

DETAILED DESCRIPTION OF THE PREFERRED EMBODIMENTS

Figure 1:
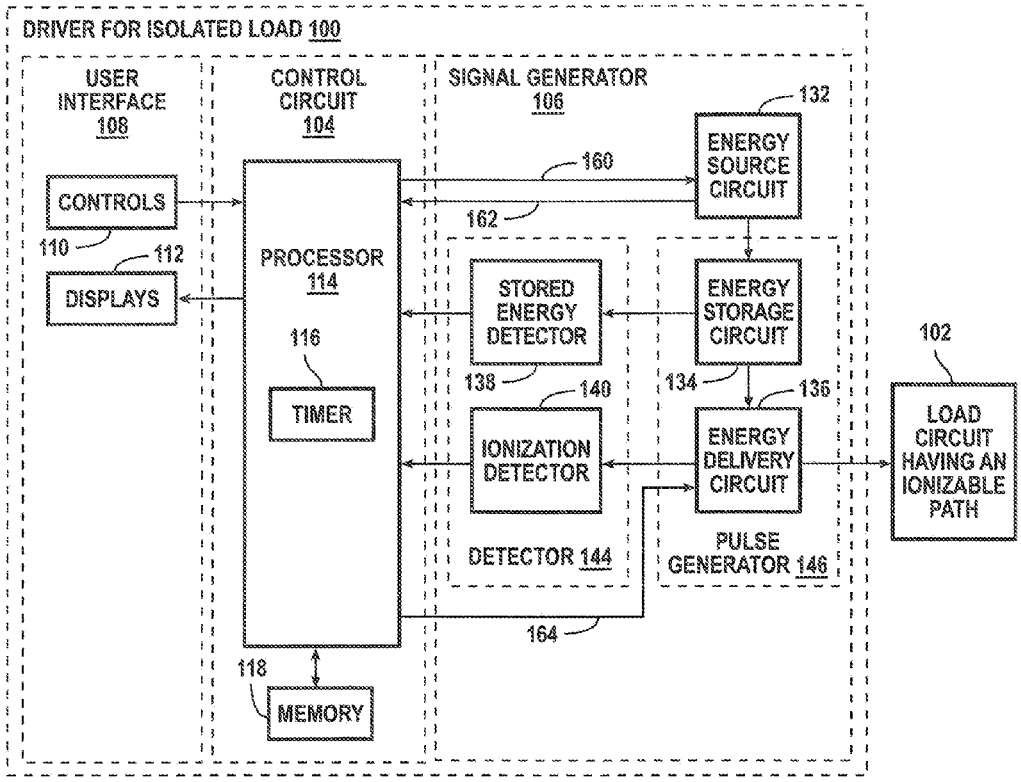
FIG. 1 is a functional block diagram of driver for an isolated load, according to various aspects of the present invention.

To provides a current through a load, a circuit must exist through the load. Ionization may be necessary to form such a circuit. The circuit exists while ionization is maintained. A relatively high voltage is generally required from a drive circuit to accomplish ionization of a particular path. When the load presents a relatively low impedance to the driver, the relatively high voltage of the driver impressed across the relatively low impedance of the load may cause a relatively high power to be dissipated in the ionized path and the load. When the insulating properties of the path vary, a lower voltage may be sufficient to accomplish ionization. Using the relatively high voltage when a lower voltage may be sufficient contributes to unnecessary power consumption. Power consumption may be reduced according to various aspects of the present invention.

Applications for drive circuits according to various aspects of the present invention may includes power distribution, communication, signal switching, igniters for engines and/or furnaces, signal generators, and specific applications for signal generators (e.g., for weapons such as electronic control devices). In the discussion that follows, aspects of the present invention will be described with reference to an electronic control device at least because power conservation may be important in such an application (e.g., a battery powered electronic control device) and an electronic control device conveniently illustrates providing a current through a relatively low impedance load (e.g., animal or human tissue) after ionization.

Electronic control devices may include, for example, contact stun devices, batons, shields, stun guns, hand guns, rifles, mortars, grenades, projectiles, mines, and area protection devices among other apparatus generally suitable for ensuring compliance with security and law enforcement. An electronic control device when used against a human or animal target causes an electric current to flow through part of the target's tissue to interfere with the target's use of its skeletal muscles. All or part of an electronic circuit may be propelled toward the target. Applications of electronic control devices may generally include a local stun function where electrodes fixed to the electronic control device (e.g., a gun or projectile) are proximate target tissue; and a remote stun function where electrodes of the electronic control device are launched away from the electronic control device (e.g., connected by conducting tether wires).

In an important application of electronic control devices, terrorists may be stopped in assaults and prevented from completing acts involving force to gain unlawful control of facilities, equipment, operators, innocent citizens, and law enforcement personnel. In other important applications of electronic control devices, suspects may be arrested by law enforcement officers, and the cooperation of persons in custody may be maintained by security officers. By interfering with the target's voluntary control of skeletal muscles of the target, the target is halted, cannot move its limbs, generally loses its balance and falls to the ground unable to move. Arrest is simplified because the target is unable to resist arrest.

An electronic control device generally includes a circuit that generates a stimulus signal and one or more electrodes. In operation, for example to stop a terrorist act, the electrodes are propelled from the electronic weaponry toward the person to be stopped or controlled. After impact, a pulsing electric current is conducted between the electrodes sufficient for interfering with the person's use of his or her skeletal muscles. Interference may include involuntary, repeated, intense, muscle contractions at a rate of 5 to 20 contractions per second.

In either a local stun or remote stun function, the electrodes of the electronic control device may not reach target tissue, for example, when pressed against or lodged in the target's clothing. The gap between the electrode and target tissue may include various insulators (e.g., additional clothing) and/or air. Air in the gap from the electrode to target tissue may be ionized by a relatively high voltage supplied by the electronic control device. Ionizing air in a gap from an electrode to target tissue may be necessary on any one or more of the pulses of the pulsed electric current. The length and composition of the gap may change from one pulse to the next.

An electronic control device, according to various aspects of the present invention, overcomes the problems discussed above, and in particular efficiently ionizes air in a gap to conduct a pulse of electric current through target tissue. In addition, after the instant of ionization, current is provided through the arc and through the tissue without an undesirable consumption of energy.

An apparatus according to various aspects of the present invention (e.g., an electronic control device) may include a drive circuit for driving an isolated load. Driving the load may include providing a suitable first quantity of energy to ionize air in a gap and providing a suitable second quantity of energy for accomplishing an effect of the load (e.g., stimulating target tissue). For example, driving a series of pulses into the load may include ionizing air in a gap for each pulse of the series. The drive circuit may adjust the first quantity of energy from pulse to pulse so that energy beyond an estimated amount is not wastefully expended for a next pulse of the series. The estimate may be based on results of attempts in driving the particular pulse and/or based on driving prior pulses in the series. Adjustment may affect how the first quantity of energy is prepared and/or delivered. For example, adjusting may include monitoring and/or controlling a voltage and/or a current associated with the first quantity of energy during storage and/or delivery.

A driver of the present invention may include a drive circuit as discussed above. An electronic control device may constitute or comprise a driver. For example, driver 100 of FIG. 1 constitutes a hand-held gun-type remote sun electronic control device that drives each pulse of a series of pulses through a load circuit 102. During each pulse a current is conducted through load circuit 102. Between pulses, substantially no current flows through load circuit 102. Ionization is necessary to establish the load circuit for each pulse. The driver may provide a predetermined number of pulses per unit time by adjusting respective times between pulses to account for incomplete attempts at ionization.

As discussed above ionization of a path in a circuit having an ionizable path permits a current to flow in the circuit. For an electronic control device, a desirable effect on target tissue (e.g., loss of voluntary control of skeletal muscles) may be accomplished when a total charge per pulse is transferred. Electric charge in motion is electric current. Delivered charge is the integral of delivered current over time. Describing delivery of current through target tissue for a duration is electrically identical to describing delivery of a desired total charge to target tissue.

The functional blocks of FIG. 1 may be implemented as separately identifiable circuits (and/or routines) or implemented with multiple function circuitry (and/or programming) in any conventional manner.

A load circuit having an ionizable path provides an electrical circuit after ionization of the ionizable path. The electrical circuit includes the load and the path. Prior to ionization, the load may conduct other current (e.g., for normal functions of the load) substantially without a current through the ionizable path (e.g., for additional or interfering functions). The ionizable path may be of relatively fixed electrical characteristics (e.g., a spark plug with rigidly spaced electrodes) or may be of relatively variable electrical characteristics (e.g., a range of isolations due to various electrode separations or various insulating materials between the electrodes).

An ionizable path typically includes one or more gaps. A gap may be provided by a conventional spark gap having an ionizable substance between its conductors (e.g., electrode assembly, packaged conductors, engine spark plug, engine igniter, furnace igniter, welder, display, RF radiator, switching component). A suitable gap may also arise from a change in position of conductors relative to each other. A suitable gap is one having an ionization within the driver's capability. According to various aspects of the present invention, a driver is capable of driving fixed gaps of a relatively wide range of isolation characteristics and/or a gap having a relatively wide range of isolation characteristics over time. For example, load circuit 102 includes tissue of a target separated from one or more conductors of driver 100. Conductors of driver 100 include each electrode as discussed above, and, for a remote stun function, one or more tether wires. Ionizable air typically occupies some or all of each separation. In FIG. 1, the functional block for load circuit 102 includes the one or more separations. Target tissue of a typical human target presents a resistance of about 400 ohms to a waveform for stimulating skeletal muscles to halt locomotion by the target.

Driver 100 may include control circuit 104, signal generator 106, and user interface 108. Any conventional electronic circuit components and technology including firmware and software may be used to construct driver 100. Control circuit 104 includes processor 114, and memory 118. Processor 114 includes timer 116. Signal generator 106 includes energy source circuit 132, detector 144, and pulse generator 146. Detector 144 includes stored energy detector 138 and ionization detector 140. Pulse generator 146 includes energy storage circuit 134 and energy delivery circuit 136. User interface 108 includes controls 110 and displays 112.

A control circuit for a driver controls operation of the driver and may perform methods according to various aspects of the present invention to accomplish providing a current through a load circuit. Controlling operation of a driver may include providing control signals to, and receiving status signals from, a signal generator. Controlling may also include interacting with a user via a user interface. For example, control circuit 104 includes a processor 114 that performs programs stored in memory 118 with reference to a timer 116. Analog and/or digital technology may be used to implement the functions of a control circuit.

A processor includes any circuit that interprets status signals and provides control signals. For example, processor 114 may include a conventional logic circuit, microprocessor, and/or microcontroller with conventional supporting circuitry hard wired or programmed to perform the methods discussed herein.

A memory provides information to a processor and stores information received from a processor. Stored information may include software, firmware, current status, and values of variable used to interpret status signals and/or provide control signals. For example, memory 118 performs read and write operations for recall and storage of information in any conventional manner. Memory 118 may be implemented with semiconductor, magnetic, and/or optical memory technology.

Actions by control circuit 104 are coordinated and sequenced by processor 114 with reference to a digital timer. A timer includes any circuit for maintaining a time base, a data/time clock, and/or programmable counters that may be polled by or interrupt a processor. Timing may be accomplished with analog technology (e.g., relaxation oscillators under program on/off control). For example, timer 116 may include a crystal oscillator and counters. Timer 116 may be a discrete circuit or packaged with processor 114.

A signal generator for a driver provides, in response to a control circuit, the output voltage and current of the driver for accomplishing the driver's functions with respect to the load circuit. In addition, a signal generator may provide one or more status signals used by the control circuit for controlling the signal generator, or for informing an operator of the driver via a user interface. For example, signal generator 106 provides to control circuit 104 information describing the energy resources available for the capabilities of signal generator 106, and provides information describing an attempted ionization. Further, signal generator 106, in response to control circuit 104, provides a series of pulses sufficient for halting locomotion by a target, as discussed above. Signal generator 106 stores energy for one or more pulses and delivers energy from storage for each pulse of the series. When a suitable external source of energy is available for signal generation functions, an energy source circuit may be omitted from signal generator 106. When energy conversion is not desired for signal generating functions, circuits for storing and reporting stored energy after conversion may be omitted.

An energy source circuit of a driver supplies electrical energy and may in addition convert energy to a form suitable for signal generating functions. An energy source circuit may include a battery and low voltage regulators and/or conventional power supply circuitry so that suitable voltages and currents may be supplied by the energy source circuit to any functions of the signal generator and driver. For example, energy source circuit 132 responds to control signals 160 from processor 114 and provides status signals 162 to processor 114. In response to control signals 160, energy source circuit 132 supplies power to pulse generator 146 of signal generator 106. Power to pulse generator 146 may be converted from battery power and supplied at a relatively high voltage (e.g., 30 KHz rectified pulses of about 2000 volts peak) to facilitate storing energy in capacitors of pulse generator 146 of relatively small physical size. The pulse repetition rate and/or peak voltage to be supplied to pulse generator 146 may be specified by control signals 160. Remaining battery capacity may be indicated by status signals 162. Processor 114 may control the magnitude, duration, and/or time separation (e.g., repetition rate) of pulses generated by pulse generator 146 by way of controlling energy source circuit 132 (e.g., on/off control of the conversion function). Processor 114 may control pulse generator 146 in response to indicia of remaining battery capacity to avoid a brown out condition (e.g., completing an operation at less than normal magnitude or at other than normal timing).

A pulse generator delivers a signal intended to provide current to pass through a load circuit having an ionizable path. If the signal is not sufficient for ionization of the path, then substantially no current is delivered. Conversely, if ionization is achieved, current may be delivered for the duration of ionization (e.g., the duration of the pulse). A pulse generator may provide status signals to a control circuit and/or receive control signals from a control circuit. In addition to forming pulses of voltage and/or current versus time, a pulse generator may perform energy conversion so that the current is delivered at a voltage different from the voltage of the energy supplied to it. A pulse generator may receive one or more control signals from a control circuit so that pulse generation is responsive to any inputs and/or methods of the control circuit. For example, pulse generator 146 receives energy from energy source circuit 132 as a series of pulses having a peak voltage of 2000 volts. Pulse generator 146 stores energy by incrementally charging one or more capacitors in an energy storage circuit 134. When an output pulse is to be delivered, pulse generator 146 delivers energy from energy storage circuit 134 at one or more voltages via an energy delivery circuit 136. Pulse generator 146 may receive one or more control signals 164 from processor 114 and in response govern any aspect of energy storage and energy delivery. For instance, control signals 164 may govern the pulse magnitude (s), duration(s), and/or separations in time for a series of output pulses delivered to load 102. Control signals 164 may be simplified or omitted when control of energy source circuit 132 is sufficient to govern energy storage (e.g., supplied energy is stored). Control signals 164 may be simplified or omitted when control of energy source circuit 132 is sufficient to govern energy delivery (e.g., delivery of some or all stored energy occurs after stored energy reaches a limit).

An energy storage circuit of a driver stores energy in a manner suitable for delivery through an energy delivery circuit to form a current through a load circuit as discussed above. For example, energy may be stored in one or more capacitors of energy storage circuit 134 collectively called a capacitance. Each pulse of energy from energy source circuit 132 tends to increase the energy stored until the voltage of the capacitance reaches the voltage of the received energy pulses. Energy storage circuit 134 may include conventional voltage multiplier technology (e.g., doubling circuits or pulse transformer circuits) to store energy at a multiple of the voltage received.

An energy delivery circuit of a driver provides energy for ionization and energy for delivery of a current through the load after ionization. An energy delivery circuit may perform an energy conversion function. For example, energy for the current may be delivered at a voltage lower than a voltage sufficient for ionization. The source impedance of an energy delivery circuit may be relatively high for delivery of energy for ionization and relatively low for delivery of energy for the current through the load after ionization. An energy delivery circuit may perform the functions of initiating and aborting energy delivery for ionization and/or delivery of the current. The functions of an energy delivery circuit may be responsive to one or more control signals from a control circuit. For example, energy delivery circuit 136 receives energy from energy storage circuit 134 and delivers energy to load circuit 102 in response to control signals 164 from processor 114. If an attempt at ionization fails, energy for ionization and/or delivery of current may remain unused in energy storage circuit 134 and/or energy delivery circuit 136; or be consumed in whole or in part by energy delivery circuit 136. Preferably, if an attempt at ionization fails, most of the energy that would have been consumed if ionization was successful is conserved for a future attempt and substantially all of the energy for the current that would have been delivered after successful ionization is conserved for a future attempt.

A detector includes any circuit that provides status information to a control circuit. Status information may include indications of quantity, indications that a limit has been reached, or merely indicia that status has changed (e.g., where processor 114 may adequately determine quantitative information based prior control signals and/or elapsed time). For example, detector 144 monitors pulse generator 146 to provide signals describing an amount of energy stored by energy storage circuit 134 and monitors energy delivery circuit 136 to provide signals describing occurrence of ionization.

Monitoring an energy storage circuit may include monitoring a voltage of a capacitance. The energy stored in a capacitance is generally given by the expression $E=1;2CV^2$ where E is energy in joules, C is capacitance in farads, and V is the voltage across the capacitance in volts. The voltage across the capacitance is consequently an indication of an amount of energy stored. Further, a change in voltage across the capacitance corresponds to a change in stored energy. Charging refers to increasing the quantity of charge stored in a capacitance and as the quantity of charge increases, so does the voltage across the capacitance. Discharging refers to removing charge from a capacitance and as current is delivered, the integral of current gives the quantity of charge removed. For example, stored energy detector 138 may include a voltage divider and/or comparator that provides one or more logic signals to processor 114 when a voltage of a capacitance of energy storage circuit 134 exceeds one or more limits. Processor 114 may include an integral analog to digital converter that performs such a voltage monitoring function. When energy storage is a predictable function of elapsed time, processor 114 may interpret an output of timer 116 as an indication of stored energy and stored energy detector 138 may be omitted. Processor 114 may make an allowance for remaining battery capacity, battery temperature, and/or battery voltage when predicting such an elapsed time.

Since prior to ionization substantially no current flows in the load circuit, detecting ionization may include detecting a current in the load circuit and/or detecting discharge of a capacitance that provided a voltage for ionization. For example, when energy delivery circuit includes a local gap in series with the ionizable path of load circuit 102, ionization of the path and the local gap may be simultaneous. Consequently, detecting ionization of the local gap may serve as a proxy for detecting ionization of the path in load circuit 102. The local gap may radiate light, heat, or radio frequency signals that may be basis for detecting ionization. The local gap may complete a circuit (e.g., operate as a switch) for current flow or provide a voltage so that detecting the current flow or voltage may indicate ionization has occurred. For example, ionization detector 140 may include a voltage divider and/or comparator that provides a logic signal to processor 114 when a voltage of a capacitance of energy storage circuit 134 that provides energy for ionization is being discharged or was discharged. When stored energy detector 138 and ionization detector 140 monitor one or more related capacitances, these two detector functions may be implemented with one circuit.

To conserve energy, losses may be minimized and efficiencies improved. Energy losses in circuitry of the type used in driver 100 include energy converted to heat via electrical resistance in the circuitry. Inefficient magnetic coupling also leads to losses as energy is divided into reflected energy converted to heat in resistances of the circuitry and transferred energy that is transferred to the load circuit. Losses and inefficiencies in circuitry of energy source circuit 132 and pulse generator 146 tend to be proportional to the voltage of power supplied, stored, and delivered. Consequently, processor 114, according to various aspects of the present invention, controls signal generator 106 in a manner to deliver current to load circuit 102 using signals having relatively lower voltages than used in the prior art.

Driver 100 may accomplish energy conservation automatically and in accordance with predetermined configuration controls as discussed above without a user interface. When user controls and/or displays are desired, driver 100 may include a suitable user interface 108. A user interface may be implemented with any conventional input technology including manual switches, touch sensitive panels (e.g., displays), and/or proximity switches (e.g., presence of user identification enabling operation). A user interface may be implemented with any conventional output technology (herein generally referred to as a display) including vibration, audio tones, voice messaging, colored lighted indicators, text displays, and/or graphics displays. Input and/or output technology may be enhanced with hermetic sealing, low power technologies (e.g., reflective or refractive indicators), and/or electrical isolation (e.g., to increase safety in the presence of high voltage circuitry).

Controls of a user interface for a driver may provide signals to request status, change configuration of the driver, and/or initiate or terminate any driver function. For example, controls 110 include a manually operated safety switch, a manually operated trigger switch, and a manually operated mode switch that provide signals to processor 114 for enabling a local stun function, enabling a remote stun function, and performing any conventional configuration management of an electronic control device.

Displays of a user interface for a driver may provide information describing status and/or configuration of the driver. For example, displays 112 include light emitting diodes lit to describe remaining battery capacity and/or a "ready/not-ready condition" of the driver for performing an electronic control device function. For instance, driver 100 may be "ready" when the safety is "off" and sufficient battery capacity is available for a remote stun function.

Methods performed by a driver according to various aspects of the present invention result in efficient use of energy for ionization. Methods, according to various aspects of the present invention, may include determining a first quantity of energy of a first ionization, and attempting a second ionization with a second quantity of energy less than the first quantity of energy. By decreasing the quantity of energy used for successive ionizations, more efficient ionization is accomplished. As a further result, energy may be efficiently used for delivery of current through a load. Since energy used for ionization may cause current to flow through the load, current through the load may be reduced as a result of reducing the energy used for ionization.

Figure 2:
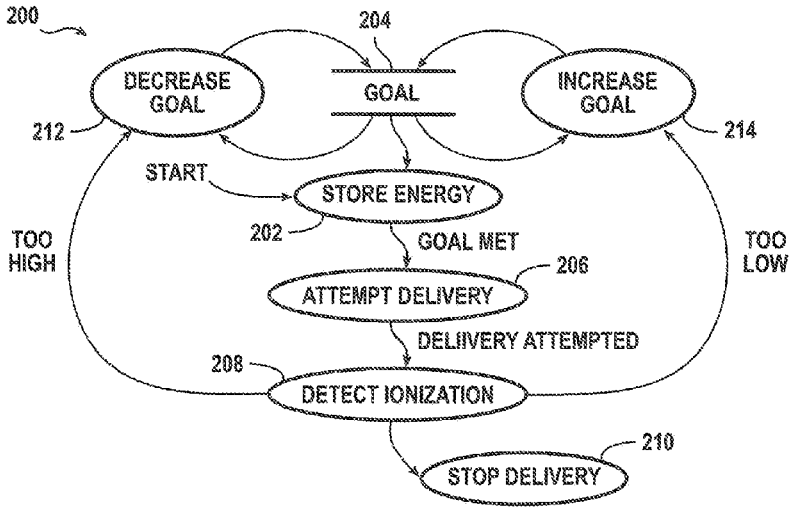
FIG. 2 is a data flow diagram of a method for regulating arc energy, according to various aspects of the present invention.

For example, a method 200 of FIG. 2 is performed by processor 114. Method 200 includes store energy process 202, attempt delivery process 206, detect ionization process 208, stop delivery process 210, decrease goal process 212, and increase goal process 214. Data stored in memory 118 and revised by operation of method 200 includes goal 204. Inter-process communication may be accomplished in any conventional manner (e.g., subroutine calls, pointers, stacks, common data areas, messages, interrupts). As desired, any of the processes of method 200 may be implemented in circuits of functional blocks other than control circuit 104.

Method 200 may be performed in a multitasking operating system environment where each process performs whenever sufficient input data is available. In other implementations, processes may be performed in a sequence similar to that described below. Multiple drivers may be operated from one method if performed in an operating system environment that supports multithreaded execution (e.g., one thread, context, or partition for each driver). In the description below, method 200 controls signal generator 106 to output a series of pulses, each pulse requiring ionization of a path in load circuit 102 of unknown characteristics. Unknown path characteristics may be encountered in an application of driver 100 as an electronic control device when electrode distance to the target is subject to change (e.g., electrodes lodged in clothing move with respect to target tissue as the target intentionally moves or falls).

Goal 204 may represent a numeric quantity of stored energy intended for an attempt at ionization. Goal 204 may be set to an initial value. The initial value may be a maximum value, a minimum value, or a mid-range value. For a driver that produces a series of pulses, it may be desirable to achieve ionization on the first pulse of the series. In such a case a maximum initial value is set. For a driver to achieve a particular quantity of successful ionizations per unit time (e.g., pulses per second) a mid-range value is set. For a driver to achieve maximum energy conservation (assuming failed attempts at ionization consume little or no energy), a minimum initial value is set. If failed attempts do consume energy, a mid-range value may be set to help avoid failed attempts. If an initial set of characteristics of the gap requiring ionization can be predicted, an initial value may be set in accordance with the initial set of characteristics.

Goal 204 may include representations of one or more numeric quantities of energy, capacitance, and/or voltage describing energy storage circuit 134; one or more numeric quantities of energy, pulse repetition rate, pulse magnitude, peak voltage, and/or peak current describing energy source circuit 132; one or more numerical quantities describing voltage conversion by energy source circuit 132, energy storage circuit 134; and/or energy delivery circuit 136. Goal 204 may include configuration settings in lieu of any of the numeric quantities (e.g., for selection of capacitance, selection of transformer turns ratios, selection of limits for automatic switching, selection of pulse repetition rates).

Goal 204 may further include historical values of the goal used in any desirable number of prior attempts at ionization. By keeping historical values, decrease goal process 212 and/or increase goal process 214 may use binary search technology to establish a next goal. By keeping historical values, decrease goal process 212 and/or increase goal process 214 may provide hysteresis and/or margins to reduce undesirable goal changes.

On receipt of a start signal, store energy process 202 reads goal 204 and outputs control signals sufficient to store energy from energy source circuit 132 in energy storage circuit 134 up to an amount of energy corresponding to goal 204. The goal energy may enable ionization. As discussed above, energy storage circuit 134 receives pulses that incrementally charge a capacitance up to a limit voltage. Energy storage circuit 134 may respond to controls from store energy process 202 to provide a desired capacitance in accordance with goal 204. Goal 204 may correspond to the limit voltage of the capacitance. The limit voltage may be achieved by a suitable quantity of pulses each pulse having the limit voltage as a peak voltage (e.g., energy source circuit 132 provides output pulses of a programmable voltage magnitude). The suitable quantity may be determined by store energy process 202 as sufficient to effect an integer quantity of time constants (e.g., 5*RC) related to the capacitance being charged. The limit voltage may be achieved by a predicted quantity of pulses of a predetermined voltage magnitude (e.g., 200 pulses at a fixed peak voltage of about 2000 volts per pulse will charge the capacitance to about 1100 volts) according to a table (not shown) stored in memory 118. The limit may be achieved by continuing charging of the capacitance until indicia from stored energy detector 138 indicate to store process 202 that goal 204 has been met.

The goal energy may be sufficient in addition to enable delivery of a suitable current through load circuit 102. An energy sufficient for current through the load may be independent of the characteristics of the ionizable path. Store energy process 202 may output controls sufficient to store energy for the current through load 102. Store energy process 202 may estimate a time suitable for meeting goal 204 and control storing of energy for both ionization and delivery of current so that goal 204 is met in about the same duration as needed to store energy sufficient for delivery of the current.

On indication that goal 204 has been met, attempt delivery process 206 may, immediately or after a suitable lapse of time, output control signals to energy delivery circuit 136 to initiate an attempt to ionize the path of load circuit 102. When delivery is automatic as discussed above, attempt delivery process 206 may be omitted.

After ionization has been attempted, detect ionization process 208 may read ionization detector 140 to determine whether the attempt succeeded or failed. For example, if ionization is not detected during a suitable period after an attempt was made, the attempt may be deemed a failed attempt. Generally, a failed attempt indicates that the energy and/or the voltage used to attempt ionization was less than necessary. A successful attempt may indicate that the energy and/or the voltage used to attempt ionization was either (a) sufficient; or (b) more than necessary. Detect ionization enables increase goal process 214 when the attempt failed; and otherwise enables decrease goal process 212.

Increase goal process 212 determines by how much the current goal should be increased to make ionization suitably likely to occur. The history of prior failed attempts, the goal for prior successful attempts, the number of successful attempts, and a required total quantity of successful ionizations in a period may be considered in determining whether: (a) a maximum energy should next be used for highly likely ionization; (b) a relatively large increase in energy should next be used to reduce a risk (or allow for the possibility) of one or more future failed attempts so as to likely meet the required total quantity of successful ionizations; or (c) a minimum increase in energy should next be used because there is still time to fail and still meet the required total quantity of successful ionizations. The determination of by how much to increase the current goal may be in accordance with a prescribed maximum energy budget per period, the cumulative energy spent in prior failed attempts at ionization during the period, and/or a predicted energy expense of failing the next attempt at ionization. In some applications, it may be reasonable to attempt ionization without change to the goal, for example, as limited by an intended hysteresis effect.

Decrease goal process 212 determines by how much the current goal should be decreased, if at all, so as to make ionization both likely to occur and as efficient as desired.

Increase goal process 214 and decrease process 212 read goal values from goal 204 and write goal values in goal 204. Written goal values may be substantially identical to existing goal values when the current goal values is not changed. By storing new values, a record of considering whether to increase or decrease the goal is made for reference in future performances of one or both of decrease goal process 212 and increase goal process 214.

When ionization is detected by process 208, stop delivery process 210 may reduce or quit discharging of a capacitance of store energy circuit 134. By reducing or quitting discharging, energy that would have been spent on successful ionization may be conserved. Conserved energy may be used to attempt a future ionization.

Figure 3A:
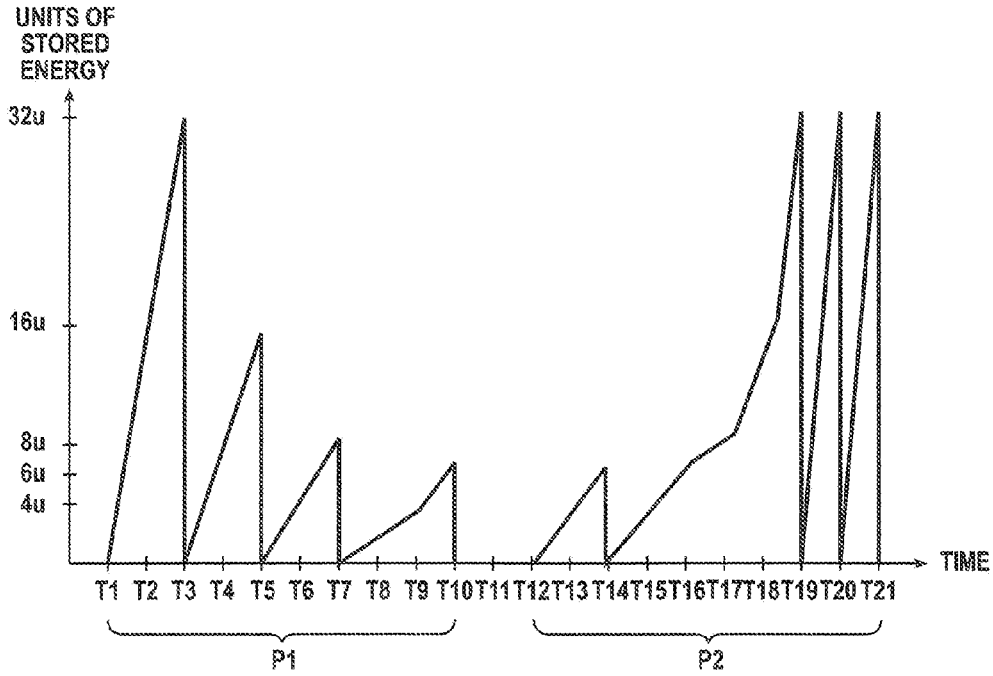
FIGS. 3A and 3B are graphs of energy versus time and detected ionization versus time for an example of operation of the driver of FIG. 1.
Figure 3B:
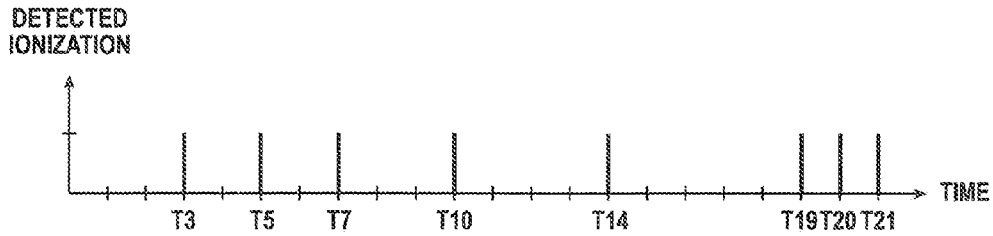

Operation of driver 100 according to method 200 may result in a series of attempted ionizations in each of several succeeding periods. An example of such a series is shown in FIGS. 3A and 3B. In FIG. 3A, energy as accumulated in and removed from energy store circuit 134 is graphed versus time. Note that the charging rate varies depending on the starting and ending values of stored energy. Other implementations may use a constant charging rate. In the example of FIGS. 3A and 3B, driver 100 is to give priority to providing 4 pulses per period. In the period P1 from time T1 to time T10 ionization is successful at times T3, T5, T7, and T10. Attempted ionization at time T9 fails.

Energy for successive attempts may be reduced in a binary search manner from an initial maximum value of 32 units which is successful at time T3. Decreasing uses an adjustment value initialized at 16 units. At time T5 and energy, reduced from 32 units to 16 units by the adjustment, accomplishes ionization. The adjustment is then halved. At time T7 an energy, reduced from 16 units to 8 units by the adjustment, accomplished ionization. The adjustment is then halved again. At time T9 an energy reduced from 8 units to 4 units by the adjustment is not sufficient for ionization. Energy is then increased by half the adjustment, that is 2 units, from 4 units to 6 units. The charging rate is doubled from time T9 to time T10 in an effort to complete the fourth pulse in period P1. Ionization is successful at time T10 with an energy of 6 units. Note that the risk of failing ionization at 6 units may be 50%. In another implementation, an energy of 8 units is used at time T10 because 8 units was successful at time T7. In still another implementation, a maximum energy for driver 100, that is 32 units in this example, is used at time T10 to assume that the fourth pulse is completed if possible during period P1. The path ionization characteristic could have changed to exceed the maximum capability of driver 100.

At time T12 preparations are made to provide a first pulse of the second period P2. To conserve energy, the energy used in this attempt is the energy of the last successful attempt at time T10, that is 6 units. In this example, at time T16, energy of 6 units fails to achieve ionization. Energy for the next attempt at time T17 is increased to the last successful energy used, 8 units at time T7. The attempt fails. Energy for the next attempt at time T18 is increased to the next prior successful energy used, 16 units at time T5. The attempt also fails. With little time to spare, the remaining three pulses are accomplished using a maximum energy and maximum charging rate for driver 100, that is 32 units at times T19, T20, and T21.

In an alternate implementation, increases in energy use the same adjustment used in decreasing energy. For instance, an adjustment of 2 units is used at time T17, the same adjustment as used at time T9. The adjustment is then doubled for each failure, that is increasing by 4 units to attempt 12 units at time T18; and by 8 units to attempt 20 units at time T19. Assuming ionization was successful at 20 units at time T19, no adjustment is needed and 20 units would be successful at times T20 and T21 expending less energy than illustrated for period P2.

In another method, according to various aspects of the present invention, changes in energy are made linearly instead of according to a binary search. For example, increase goal process 214 always adds a fixed adjustment to the current goal energy value to determine the next energy value for goal 204. Decrease goal process 212 subtracts a fixed adjustment from the current goal energy value to determine the next energy value for goal 204. Decrease goal process 212 may implement hysteresis to avoid excessive changes to goal 204 (e.g., toggling due to the ambiguity of whether ionization was (a) sufficient; or (b) more than necessary as discussed above).

Figure 4:
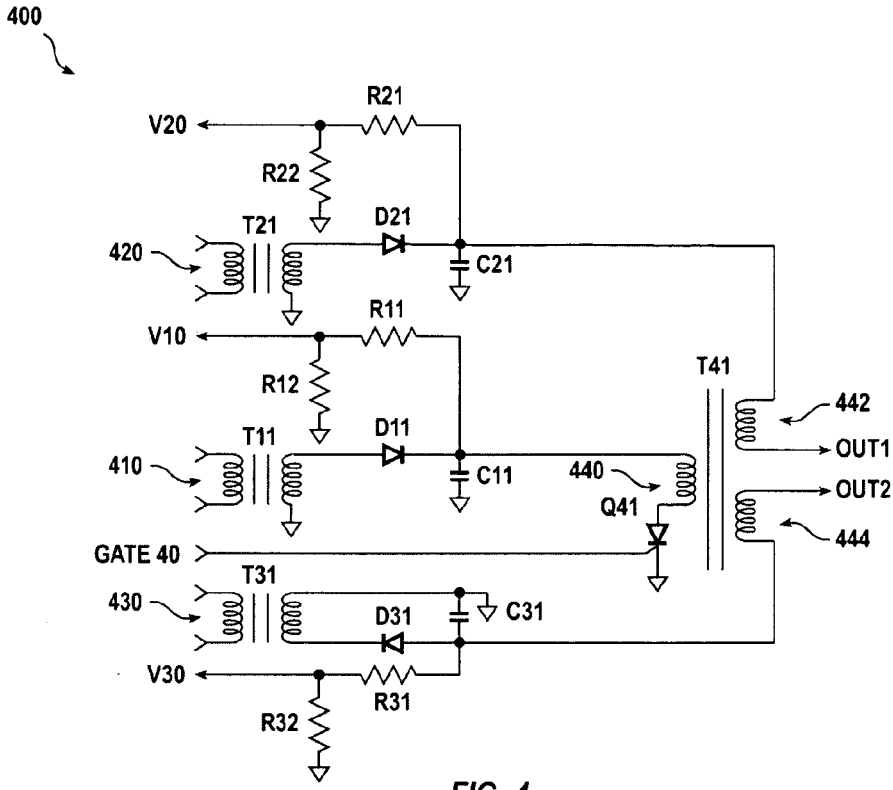
FIG. 4 is schematic diagram of a pulse generator for an implementation of the driver of FIG. 1.

Implementations of the functions described above with reference to FIGS. 1 through 3 may include transformers for energy conversion (e.g., voltage step up), capacitors for energy storage (e.g., capacitors for energy for ionization and same or different capacitors for current or charge delivery), and switches (e.g., spark gap components, semiconductor switches, transistors (IGBJTs), rectifiers (SCRs)). For example, FIG. 4 presents a partial schematic diagram of circuit 400 for a driver 100 that performs the functions of pulse generator 146 and detector 144.

Functions of energy delivery circuit 136 are provided by SCR Q41, and transformer T41. Transformer T41 includes one primary winding 440 and two secondary windings 442 and 444. Winding 442 provides signal OUT1. Winding 444 provides signal OUT2. Load 102 having an ionizable path is coupled (e.g., via tether wires and electrodes) to circuit 400 output signals OUT1 and OUT2. The differential voltage of signals OUT1 and OUT2 communicates the energy for ionization and delivers the current through the load 102.

Circuit 400 includes an isolation energy store comprising transformer T11, diode, D11, capacitor C11, resistors R11 and R12, transformer T41, and SCR Q41. Initially, capacitor C11 may have a negligible residual stored charge, and SCR Q11 is non-conducting. In operation, an energy source (not shown) provides a square wave signal (e.g., about 30 Hz, about 2000 volts peak) into primary winding 410 of transformer T11 for a period proportional to the desired energy to be stored in capacitor C11. Transformer T11 converts the square wave signal to a stepped up output signal (e.g., about 6000 volts). Diode D11 rectifies the stepped up output signal to produce pulses that incrementally charge capacitor C11 during the period. The voltage across capacitor C11 to ground is proportional to energy stored. A signal V10, available for monitoring by a processor (not shown) via a voltage divider formed of resistors R11 and R12, has a voltage proportional to the voltage across capacitor C11. Capacitor C11 holds the stored charge (e.g., maintains the voltage across C11) until signal GATE40 from the processor (not shown) fires SCR Q41. After firing SCR Q41, capacitor C11 discharges through primary winding 440 of transformer T41. Typically, capacitor C11 discharges completely without interruption (e.g., voltage across C11 goes from an initial maximum, due to stored charge, to zero). Transformer T41 converts the discharge energy of capacitor C11 by again stepping up the voltage for attempting ionization. The differential voltage between output signals OUT1 and OUT2 is a fixed multiple of the voltage in primary 440 which corresponds to the voltage across capacitor C11.

Ionization is detected by the voltage divider formed of resistors R11 and R12 that provides signal V10. The processor (not shown) analyzes signal V10. If voltage V10 soon after provision of signal GATE40 decreases below a limit voltage (e.g., about 1000 volts), then ionization is deemed to have occurred. Otherwise attempted ionization is deemed to have failed.

Two identical sub-circuits of circuit 400 store energy for providing the current through load 201. Each drive current energy store includes a transformer T21 (T31), a diode D21 (D31), a capacitor C21 (C31), and resistors R21 (R31) and R22 (R32). Initially, capacitor C21 (C31) may have a negligible residual stored charge. No power from these sub-circuits is transferred through transformer T41 until ionization occurs. In operation, an energy source (not shown) provides a square wave signal (e.g., about 30 Hz, about 2000 volts peak) into primary winding 420 (430) of transformer T21 (T31) for a period proportional to the desired energy to be stored in capacitor C21 (C31). Capacitors C21 and C31 may store any desired energy (e.g., equally or unequally). Transformer T21 (T31) converts the square wave signal to a stepped up output signal (e.g., about 6000 volts). Transformers T21 and T31 may have different turns ratios as desired. Diode D21 (D31) rectifies the stepped up output signal to produce pulses that incrementally charge capacitor C21 (C31) during the period. The voltage across capacitor C21 (C31) to ground is proportional to energy stored. A signal V20 (V30), available for monitoring by a processor (not shown) via a voltage divider formed of resistors R21 (R31) and R22 (R32), has a voltage proportional to the voltage across capacitor C21 (C31). Capacitor C21 (C31) holds the stored charge (e.g., maintains the voltage across C21 (C31) until ionization completes a circuit for discharging capacitor C21 (C31). After ionization, capacitor C21 (C31) discharges through secondary winding 442 (444) of transformer T41. Typically, capacitor C21 (C31) discharges completely without interruption (e.g., voltage across C21 (C31) goes from an initial maximum, due to stored charge, to zero). Transformer T41 does not perform a step up conversion function on the discharged energy of capacitor C21 (C31). The differential voltage between output signals OUT1 and OUT2 is approximately the differential voltage between capacitors C21 and C31. Because diodes D21 and D31 are in opposite polarities with respect to capacitors C21 and C31, these capacitors' voltages may be opposite (e.g., +6000 volts and −6000 volts respectively).

For driver 100 implemented for operation as an electronic control device, energy stored on capacitor C11 is in the range from 0.1 joule to 0.6 joule (C11 may be about 0.22 microfarads). Energy stored on capacitors C21 and C31 may be in sum 0.5 joule to 8.0 joule (C21 and C31 may be about 0.88 microfarads).

Figure 5:
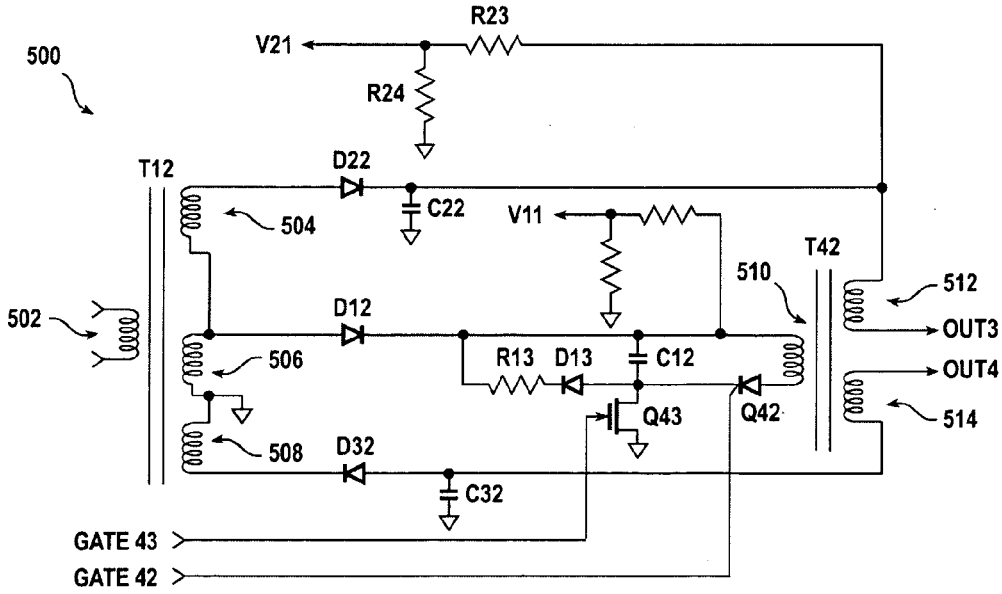
FIG. 5 is a schematic diagram of a pulse generator for another implementation of the driver of FIG. 1.

For another example, FIG. 5 presents a partial schematic diagram of circuit 500 for a driver 100 that performs the functions of pulse generator 146 and detector 144.

Functions of energy delivery circuit 136 are provided by SCR Q42, and transformer T42. Transformer T42 includes one primary winding 510 and two secondary windings 512 and 514. Winding 512 provides signal OUT3. Winding 514 provides signal OUT4. Load 102 having an ionizable path is coupled (e.g., via tether wires and electrodes) to circuit 500 output signals OUT3 and OUT4. The differential voltage of signals OUT3 and OUT4 communicates the energy for ionization and delivers the current through the load 102.

Circuit 500 includes an isolation energy store comprising winding 506 of transformer T12, diode D12, capacitor C12, snubber R13, D13 and SCR Q43. These components perform functions analogous to the isolation energy store of circuit 400 discussed above. In addition, the processor (not shown) provides signal GATE 43 to fire SCR Q43 to safety discharge capacitor C12 (e.g., responsive to the safety switch of user interface 108 indicating operation of driver 100 is not desired). SCR Q43 may be replaced with a FET.

Circuit 500 further includes two drive current energy store sub-circuits that each include a winding 504 (508) of transformer T12, a diode D22 (D32), a capacitor C22 (C32). operation is analogous to the drive current energy store sub-circuits discussed above with reference to circuit 400.

In circuit 500, ionization is detected by the voltage divider formed of resistors R23 and R24 that provides signal V21. The processor (not shown) analyzes signal V21. If voltage V21 soon after provision of signal GATE42 decreases below a limit voltage (e.g., about 1000 volts), then ionization is deemed to have occurred. Otherwise attempted ionization is deemed to have failed. Voltage V21 directly indicates delivery of current through load 102. Since delivery cannot occur without a preceding ionization, voltage V21 is a reliable proxy (e.g., an indirect indicator) for directly detecting ionization (e.g., as in circuit 400).

The foregoing description discussed preferred embodiments of the present invention which may be changed or modified without departing from the scope of the present invention as defined in the claims. While for the sake of clarity of description, several specific embodiments of the invention have been described, the scope of the invention is intended to be measured by the claims as set forth below.

What is claimed is:

1. A method performed by an electronic control device, the method comprising:

attempting, in accordance with a goal, delivery of energy for ionization;

detecting whether ionization occurred;

after ionization, delivering a current through a human or animal target for interfering with control by the target of skeletal muscles of the target; and adjusting the goal to conserve energy expended for ionization.

2. The method for claim 1 wherein the goal comprises a value representing a quantity of stored energy.

3. The method of claim 1 wherein the goal comprises a value representing a quantity of capacitance for storing energy.

4. The method of claim 1 wherein the goal comprises a value representing a voltage corresponding to stored energy.

5. The method of claim 1 wherein attempting delivery comprises storing, in accordance with the goal, energy for delivery.

6. The method of claim 1 wherein attempting delivery comprises performing energy conversion in accordance with the goal.

7. The method of claim 1 wherein:

the goal comprises a configuration setting for a circuit that stores energy for delivery for ionization; and attempting delivery comprises reconfiguring the circuit in accordance with the configuration setting.

8. The method of claim 1 wherein the goal comprises a current value of the goal and a plurality of historical values of the goal, each historical value used in a prior attempted delivery.

9. The method of claim 1 wherein:

delivery of energy for ionization comprises discharging a capacitance having a voltage across the capacitance; and detecting ionization comprises detecting that the voltage has changed.

10. The method of claim 1 wherein detecting ionization comprises detecting delivery of the current.

11. The method of claim 1 wherein:

the current comprises a plurality of pulses; and delivering the current comprises delivering each pulse after a respective ionization.

12. The method of claim 1 wherein adjusting is performed in response to a failure of detecting ionization.

13. The method of claim 1 wherein adjusting is performed in response to a success of detecting ionization.

14. The method of claim 1 wherein adjusting accomplishes a linear change in a value of the goal.

15. The method of claim 1 wherein:

adjusting comprises changing a value of the goal in accordance with an adjustment amount; and adjusting further comprises changing the adjustment amount.

16. The method of claim 1 wherein:

the goal comprises a current value of the goal and a plurality of historical values of the goal, each historical value used in a prior attempted delivery;

adjusting comprises changing the current value of the goal in accordance with an adjustment amount; and adjusting comprises changing the adjustment amount in accordance with an historical value of the plurality of historical values.

17. The method of claim 16 wherein changing the current value of the goal and changing the adjustment amount conform to binary searching.

18. The method of claim 1 wherein:

the current comprises a plurality of pulses and the current thereby has a pulse rate; and the method further comprises repeating adjusting, attempting, and delivering each pulse of the plurality of pulses to control the pulse rate.

19. The method of claim 1 wherein:

the current comprises a plurality of pulses and the current thereby has a pulse rate;

the method further comprises repeating adjusting, attempting, and delivering each pulse of the plurality of pulses to control the pulse rate;

the goal comprises a current value of the goal and a plurality of historical values of the goal, each historical value used in a prior attempted delivery;

adjusting comprises changing the current value of the goal in accordance with an adjustment amount; and adjusting comprises changing the adjustment amount in accordance with an historical value of the plurality of historical values and in accordance with a predetermined pulse rate.

20. The method of claim 1 wherein attempting delivery for a particular ionization comprises stopping delivery of energy for the particular ionization after the ionization has occurred and before a total energy is expended that was available for delivery for the particular ionization.

* * * * *

UNITED STATES PATENT AND TRADEMARK OFFICE

CERTIFICATE OF CORRECTION

PATENT NO. : 7,457,096 B2
APPLICATION NO. : 11/381454
DATED : November 25, 2008
INVENTOR(S) : Steven N. D. Brundula It is certified that error appears in the above-identified patent and that said Letters Patent is hereby corrected as shown below:

In column 1, line 15, after "heat" insert -- , --.

In column 2, line 11, delete "that" and insert -- the --, therefor.

In column 2, line 27, after "is" insert -- a --.

In column 2, line 35, delete "provides" and insert -- provide --, therefor.

In column 2, line 51, delete "includes" and insert -- include --, therefor.

In column 4, line 6, delete "sun" and insert -- stun --, therefor.

In column 5, line 26, delete "variable" and insert -- variables --, therefor.

In column 5, line 34, delete "data/time" and insert -- date/time --, therefor.

In column 7, line 35, delete "$E=/1;2CV^{2}$" and insert -- $E=\frac{1}{2}CV^{2}$ --, therefor.

In column 9, line 56, delete "numerical" and insert -- numeric --, therefor.

In column 9, line 58, delete "134;" and insert -- 134, --, therefor.

In column 11, line 17, after "current goal", delete "values" and insert -- value --, therefor.

In column 11, line 43, delete "and" and insert -- an --, therefor.

In column 11, line 58, delete "assume" and insert -- assure --, therefor.

In column 13, line 39, delete "(C31)" and insert -- (C31)) --, therefor.

In column 14, line 9, delete "safety" and insert -- safely --, therefor.

In column 14, lines 15-16, delete "operation" and insert -- Operation --, therefor.

In column 14, line 29, delete "discussed" and insert -- discusses --, therefor.

In column 14, line 49, in Claim 2, delete "for" and insert -- of --, therefor.

Signed and Sealed this
Twenty-seventh Day of September, 2011

David J. Kappos

David J. Kappos
*Director of the United States Patent and Trademark Office*